United States Patent [19]

Mazurk

[11] 4,317,011

[45] Feb. 23, 1982

[54] MEMBRANE TOUCH SWITCH

[75] Inventor: Louis R. Mazurk, Glenview, Ill.

[73] Assignee: Chicago Decal Company, Chicago, Ill.

[21] Appl. No.: 113,609

[22] Filed: Jan. 21, 1980

[51] Int. Cl.[3] ..... H01H 13/70

[52] U.S. Cl. ..... 200/5 A; 200/159 B; 200/267; 200/268; 200/308

[58] Field of Search ..... 200/5 A, 5 R, 159 B, 200/266, 267, 268, 292, 302, 314, 317, 308

[56] References Cited

U.S. PATENT DOCUMENTS

| | | | |
|---|---|---|---|
| 3,777,222 | 12/1973 | Harris | 200/317 X |
| 3,784,812 | 1/1974 | Swanberg | 200/5 A X |
| 3,811,025 | 5/1974 | Bach | 200/5 A X |
| 3,862,381 | 1/1975 | Glaister et al. | 200/5 A |
| 4,007,342 | 2/1977 | Makino et al. | 200/267 X |
| 4,143,253 | 3/1979 | Wagner et al. | 200/5 A |
| 4,145,584 | 3/1979 | Otterlei | 200/5 A |
| 4,218,600 | 8/1980 | Kissner | 200/159 B |

OTHER PUBLICATIONS

Design News; Design Ideas; "Rotary Switch Squeezes Into Minimal Envelope", R. F. Stengel, pp. 52, 53.

*Primary Examiner*—James R. Scott
*Attorney, Agent, or Firm*—Anthony S. Zummer

[57] ABSTRACT

The subject matter of this invention relates to a membrane switch having a base sheet with a plurality of conductors on one surface of the sheet. A spacer sheet is adhesively secured to the base sheet on the surface having the plurality of conductors. The spacer sheet has a plurality of apertures, which apertures are aligned with selected portions of the conductors. A flexible cover sheet is adhesively secured to the spacer sheet. The flexible cover sheet has a second plurality of flexible conductors on its surface adjacent to the spacer sheet. The flexible conductors have selected portions aligned with respective apertures. Each of the flexible conductors has a thickness no greater than 0.0025 mil. The flexible cover sheet is positionable through a selected aperture with a portion of the flexible conductor to contact electrically the respective conductor on the base sheet aligned with that aperture.

13 Claims, 7 Drawing Figures

FIG. 1
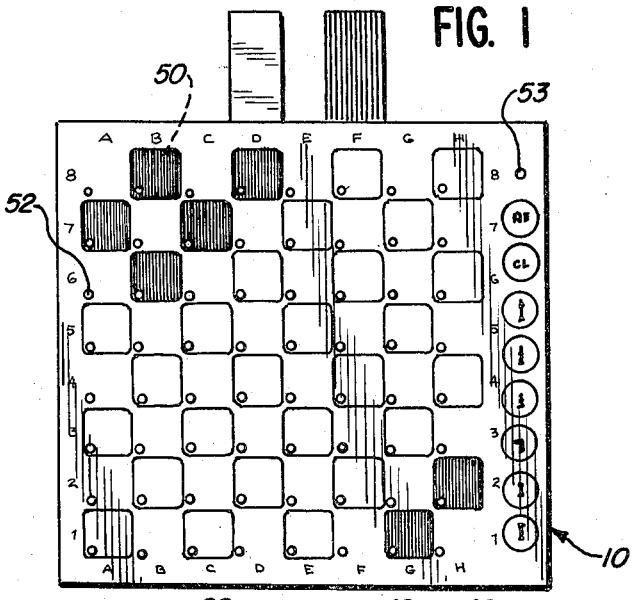
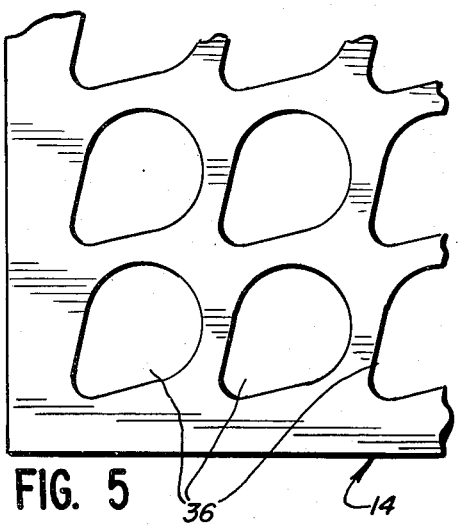
FIG. 5
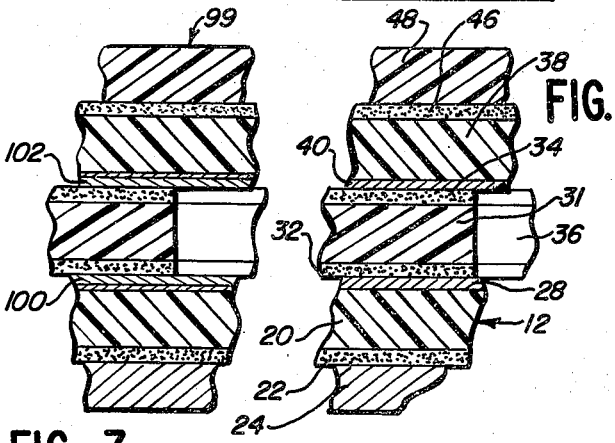
FIG. 6
FIG. 7
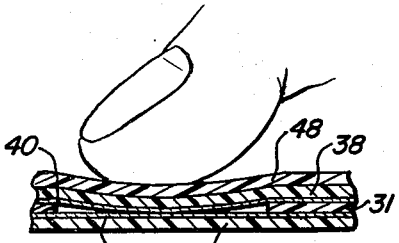
FIG. 3
FIG. 4
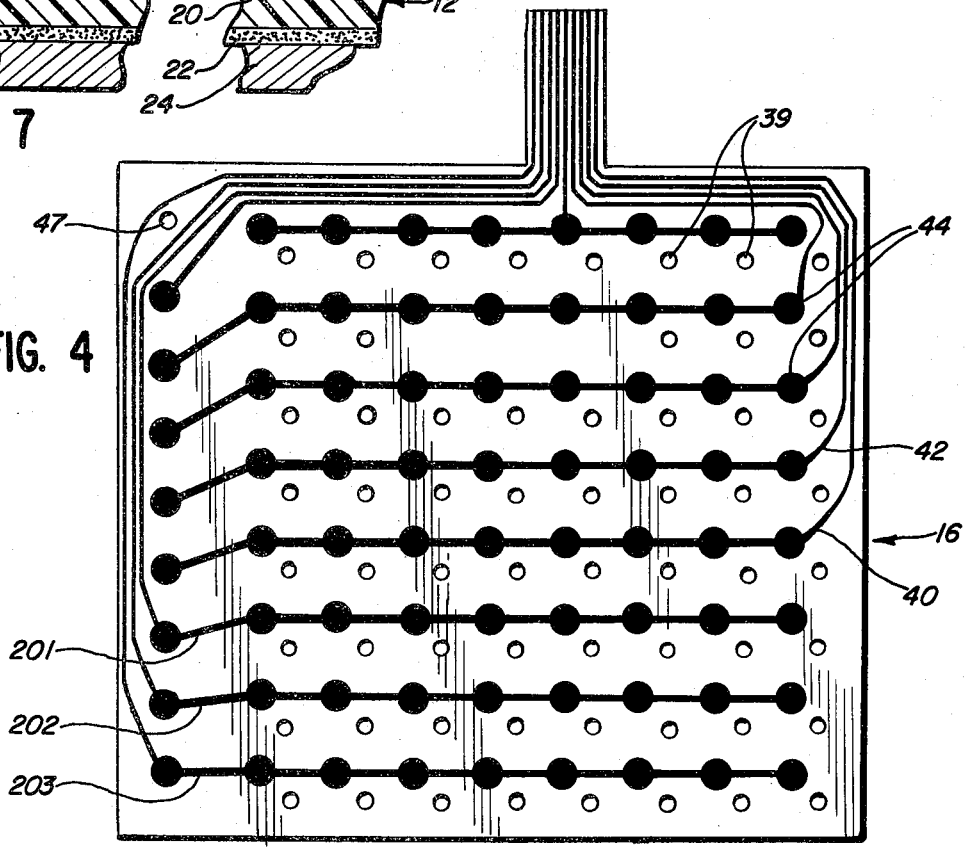

MEMBRANE TOUCH SWITCH

BACKGROUND OF INVENTION

A membrane switch is generally utilized for an application wherein a light force is applied to an indicator to make an electrical contact which in turn controls certain selected electrical circuitry. The general construction of a membrane switch includes a base which has a plurality of conductors mounted on the base. A flexible sheet with a plurality of flexible conductors on one side of the sheet is mounted in alignment and spaced from the base. Selected portions of the flexible conductors on the flexible sheet are aligned with selected portions of the conductors on the base. Accordingly, the application of a force to the flexible sheet at a selected point moves an associated conductor toward an aligned conductor on the base until the conductors contact each other to complete an electrical circuit. The customary method of keeping the flexible sheet spaced a selected distance from the base sheet is to provide a spacer sheet having a selected thickness. The spacer sheet has apertures formed therein to allow selected portions of the flexible sheet to contact selected portions of the conductors on the base through respective apertures. An indicator sheet carrying indicia is mounted on the flexible sheet in alignment with the apertures to provide indicia which acts as a target for an operator applying a force to the flexible sheet.

A typical construction of a membrane switch of this general type is disclosed in U.S. Pat. No. 3,591,749 to James Martin Comstock, which patent is entitled Printed Circuit Keyboard. The Comstock disclosure teaches a membrane switch which has the broad basic construction described above and includes a transparent sheet for protecting the indicia which is positioned for indicating points for application of flexing force.

It is appreciated that membrane switches are utilized in applications were a force is applied to a flexible sheet to distend the sheet through an aperture and then contact the sheet on the other side. The flexible sheet has a conductor mounted thereon and this conductor must also be distended. Not only must it be distended, but it must also adhere to the sheet and not flake off or brake off even after many flexures of the sheet.

Ordinarily, membrane switches are used in applications were the voltage applied between opposite sides is low and the amperage is also low. In certain applications, it is desirable to provide a conductor on a flexible sheet which has a minimum amount of resistance but still may be made relatively inexpensively. Various materials are known to be used as conductors, and an obvious conductor is gold which is taught in U.S. Pat. Nos. 4,066,852, 4,066,853, 4,066,854 and 4,066,855 to George Edward Zenk. U.S. Pat. No. 4,085,302 to Zenk et al also discloses a gold film which is used in a membrane switch. U.S. Pat. No. 4,035,593 to James P. Riniker entitled Flexible Pressure Sensitive Switch Actuator Module Adaptable to a Keyboard Surface Having Fixed Contact Array teaches the use of silver film material. U.S. Pat. No. 4,154,178 to Jack Brown et al entitled High Density Programming Means for Programmable Sewing Machine teaches the use of berryllium copper having a layer of 2 mils thickness. U.S. Pat. No. 4,143,253 to Wagner et al entitled Optically Clear Membrane Switch teaches conductors having layers of copper, nickel and gold. The prior art teaches the utilization of a plurality of layers of conductive material in order to provide conductors having a minimum of resistance.

SUMMARY OF INVENTION

The instant invention is directed to an improved membrane switch construction. The present construction includes a base sheet which has a plurality of conductors on the sheet. A spacer sheet is adhesively secured to the side of the base sheet having the conductors. The spacer sheet has a plurality of apertures which are aligned with selected portions of selected conductors on the base sheet. A flexible cover sheet is also adhesively secured to the spacer sheet. The flexible cover sheet also has a plurality of flexible conductors on the side of the flexible cover sheet adjacent to the conductors on the base sheet. Each of the flexible conductors has selected portions positioned in alignment with selected apertures so that flexure of the flexible sheet through the aperture contacts the conductor on the flexible sheet with the conductor on the base sheet to complete an electrical circuit. The flexible conductors on the flexible sheet are formed by a layer of conductive metal having a thickness no greater than 0.0025 mil. In an application wherein it is desirable to have a low resistance in the conductive lines, the conductive metal is a pure vacuum vapor deposited aluminum with a thicker layer of silver in contact therewith thereby reducing the resistance of the conductive lines.

It is therefore a principal object of the present invention to provide an improved membrane switch construction which membrane switch has a high degree of flexibility and a long life and is inexpensive to manufacture.

Another object of this invention is to provide an improved membrane switch construction wherein the membrane switch has a conductive material in the form of a thin film of aluminum having a thickness of no greater than 0.0025 mil.

It is another object of the herein disclosed invention to provide an improved membrane switch construction which has a conductor with a low resistance.

Other objects and uses of this invention will become readily apparent to those skilled in the are upon perusal of the following specification in light of the accompanying drawings.

BRIEF DESCRIPTION OF THE DRAWINGS

FIG. 1 is a plan view of a specific membrane switch construction embodying the herein disclosed invention wherein the membrane switch is particularly adapted for use as a chessboard;

FIG. 3 is an enlarged cross sectional view showing a portion of the membrane switch of FIG. 1 being flexed in order to complete an electrical circuit;

FIG. 4 is a plan view of a flexible cover sheet which is a portion of the instant membrane switch showing the arrangement of the conductors on that sheet;

FIG. 5 is a portion of an enlarged plan view of a portion of a spacer which is a part of the instant membrane switch;

FIG. 6 is an enlarged cross sectional view showing the various layers of the instant membrane switch; and FIG. 7 is an enlarged cross sectional view showing the layers of the subject membrane switch wherein the conductors have an added layer of a second conductive material.

DESCRIPTION OF THE PREFERRED EMBODIMENT

Figure 2:
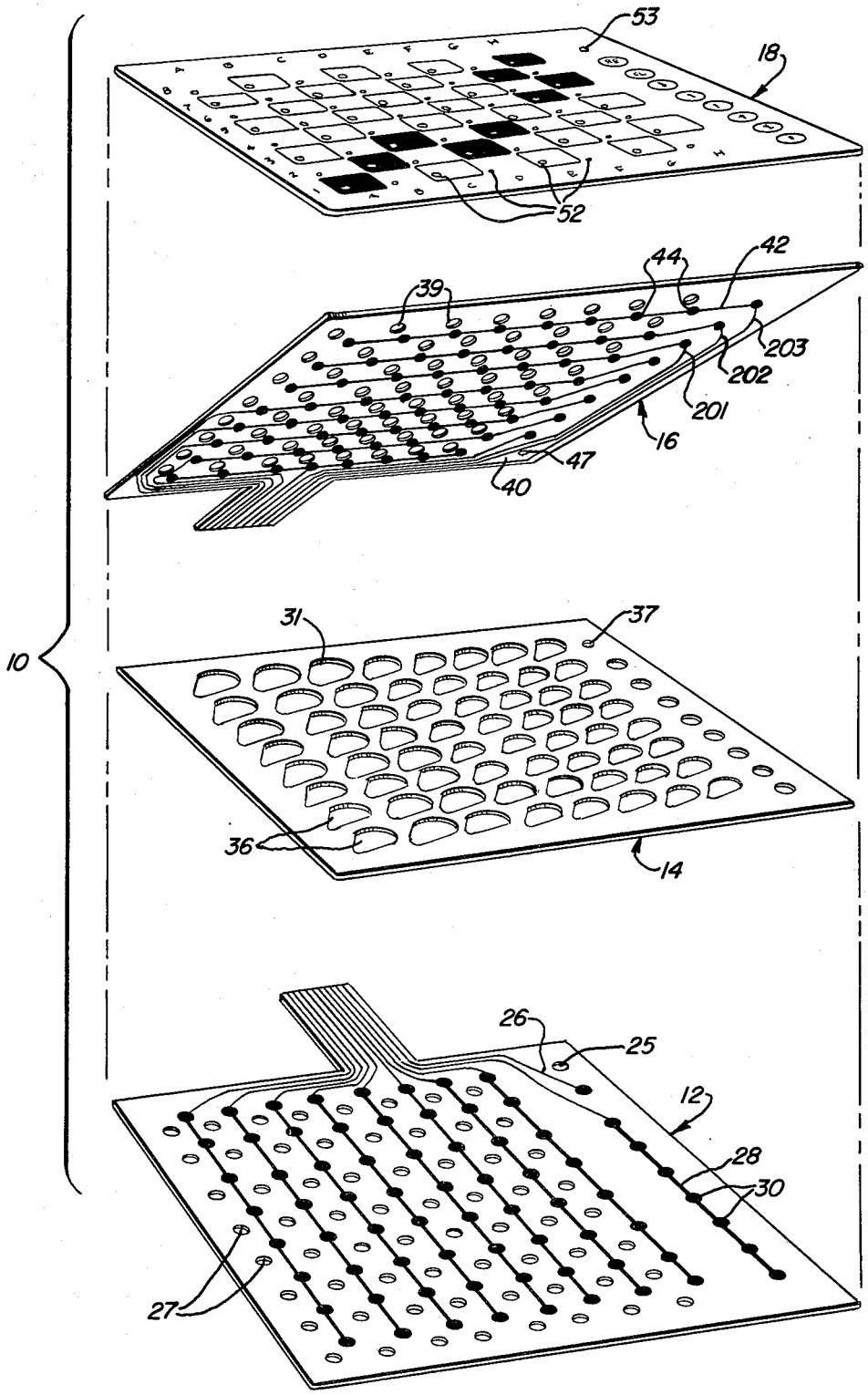
FIG. 2 is an exploded view of the membrane switch of FIG. 1 with one of the members being titled in order to show better the arrangement of the conductors on the titled member.

Referring now to FIG. 1, a membrane switch, embodying the instant invention, generally indicated by number 10 is shown therein. In this instance, for purposes of illustration, membrane switch 10 is shown with a conventional chessboard surface, which switch is connected to a computer to allow a player to play chess against the computer. Although the subject invention is hereinafter described in relation to the specific construction of the membrane switch for use in connection with a chessboard which is adapted for use with a computer, it will be readily apparent to those skilled in the art that the instant invention may be used in other applications.

The membrane switch 10 generally consists of four major parts; to wit, a base sheet 12, a spacer sheet 14, a flexible cover sheet 16 and an indicator sheet 18. The four sheets are adhesively secured to adjacent sheets in a sandwichlike construction as shown in cross section in FIGS. 3 and 6.

The base sheet 12 has as its base a polyethylene glycol terephthalate film 20. This film has a thickness of 2 mils. A conventional acrylic adhesive is applied to one side of the film in the form of adhesive layer 22. A release sheet 24 is removably mounted on adhesive layer 22 so that the release sheet may be removed to secure base sheet 12 on a selected surface. The base sheet has a pilot aperture 25 in one corner. Base sheet 20 has a plurality of conductors 26 on the surface of the film opposite the surface with adhesive layer 22. A plurality of signal apertures 27 is formed in film 20.

Conductors 26 are discrete thin conductive lines 28 with enlarged pads 30 formed integral with the lines. The conductive lines and pads are formed of a thin layer of pure aluminum having a thickness of 0.0025 mil. The aluminum is vacuum vapor deposited onto the entire one side of film 20. A portion of the aluminum is then etched away by means of conventional and well known process to leave the lines and pads on film 20.

Spacer sheet 14 includes a film 31 of polyethylene glycol terephthalate having a thickness of 10 mils. Film 31 has a base adhesive layer 32 on one side and a cover adhesive layer 34 on the other side. The adhesive of adhesive layers 32 and 34 is the conventional and well-known acrylic adhesive which is identical to the adhesive of adhesive layer 22. Film 31 also has a plurality of apertures 35 contained therein, which apertures are positioned in alignment with pads 30. The spacer sheet has a pilot aperture 37 in one corner which is aligned with pilot aperture 25 of the base sheet.

Flexible cover sheet 16 also includes a film 38 which is also polyethylene glycol terephthalate having a thickness of 2 mils. Film 38 has a plurality of signal apertures 39 formed thereon which align with apertures 27 of the base sheet and certain of apertures 36 of the spacer sheet. Conductors 40 are secured to one side of film 38. Conductors 40 have a plurality of discrete conductive lines 42 with a plurality of pads 44 formed integral with each of the lines 42. Conductive lines 42 and pads 44 are formed by a layer of vacuum vapor deposited pure aluminum having a thickness of 0.0025 mil. As with base sheet 12, flexible cover sheet 16 has the conductive lines and pads formed thereon by vacuum vapor depositing a layer of pure aluminum on one entire side of the sheet and etching away unwanted aluminum in a well-known manner. An adhesive layer 46 is applied to the other side of film 38. The adhesive of adhesive layer 46 is also the same acrylic adhesive as that in adhesive layer 22. Cover sheet 18 also has a pilot aperture 47 which is aligned with pilot apertures 25 and 37 of base sheet 12 and spacer sheet 14, respectively.

Indicator sheet 18 is a transparent polycarbonate film 48 having a thickness of 10 mils. The polycarbonate film has a velvet texture on the side away from cover sheet 16 and indicia 50 on the side adjacent to the cover sheet. The indicia is in the form of 64 squares of a chessboard with other indicia on one edge. The sheet contains a signal aperture 52 adjacent to one corner of each square. Each aperture 52 is aligned with respective signal apertures 27 and 39 and certain of the apertures 36 for receiving an L.E.D. as an indicator. A pilot aperture 53 is formed in one corner of the indicator sheet and is aligned with the other pilot apertures, 27, 37 and 47.

The subject membrane switch is assembled as a unit in a jig, or a fixture using the pilot aperture in the sheets to guide the sheets into correct registery.

Base sheet 12, with adhesive layer 22 and backing 24 mounted therein, is first placed in the jig, or fixture, after the conductive lines and pads have been formed on the surface of film 20. The spacer sheet 14 is made with an adhesive layer on opposite sides there. A conventional release sheet (not shown) is removedly mounted on each of the adhesive layers to allow the spacer to be handled. The release sheets are removed from the spacer sheet. The spacer sheet is then placed above the base sheet so that adhesive layer 32 comes in contact with film 20 to secure the spacer sheet to the base sheet. The jig, or fixture, in cooperation with pilot apertures 27 and 37, aligns the apertures 36 in the spacer sheet with appropriate pads of the base sheet.

The flexible cover sheet is made with adhesive layer 46 on the side opposite that having the conductive lines and pads. A conventional release sheet (not shown) is also mounted on adhesive layer 46. The release sheet on the cover sheet is removed from the adhesive layer, and the cover sheet is placed into a jig, or fixture, with the conductive lines and pads adjacent to the spacer sheet. Film 38 is aligned with the spacer sheet by means of pilot apertures 47. After alignment, film 38 is placed into contact with adhesive layer 34 to secure the flexible cover sheet to the spacer sheet. It is to be appreciated that pads 44 on the flexible cover sheet are aligned with selected apertures 36 in the spacer sheet so that each aperture 36 has a pad 30 on one side and a pad 44 on the other side.

Indicator sheet 18 has indicia 50 applied thereto by a silk screen process. The indicator sheet is also placed into the jig, or fixture and aligned by means of pilot aperture 53, so that indicator sheet is in proper registry with the cover sheet when adhesive layer 46 secures the indicator sheet to the cover sheet. The membrane switch is now a complete unit.

In order to mount the completed membrane switch in an operative position, it is only necessary to remove release sheet 24 thereby exposing adhesive layer 22 to allow the base sheet to be mounted on a selected member, such as, a piece of sheet metal.

When the membrane switch is to be operated, the operator need only consult the indicia to determine the circuit which he wishes to close. By applying a force to the selected indicia, flexible cover sheet 16 is distended so that film 38, with respective portion of the conductive line and pad adjacent thereto, is moved through aperture 36 until selected pad 44 on the distended portion of the flexible cover sheet comes in contact with a pad 30 on the base sheet. It may be appreciated that in order for the conductive line and pad to move from its rest position to contact the pad and conductive line on the base sheet, the conductive line must be distended and repeated movements of the flexible cover sheet applies repeated stress to the metal on the film. The extremely thin film of aluminum allows the metal to be distended and to adhere to the film without flaking off.

It has been observed that by applying a layer of silver to the conductive lines and pads formed by the vacuum vapor deposited aluminum, the conductivity of the thin aluminum with the silver is greatly enhanced. FIG. 7 is a cross sectional view of a portion of a membrane switch 99 which is substantially identical to membrane switch 10 hereinabove disclosed in detail. However, membrane switch 99 has a layer of silver applied to and in electrical contact with the conductive lines and pads. All of the remaining parts are identical and like numbers are used except that a layer of silver 100 is applied to the aluminum conductor 28, and a layer of silver 102 is applied to the aluminum conductor 40. The parts are made in the same general fashion except that in each case were the silver layer is applied, the aluminum layer is first vacuum vapor deposited on its respective film. The shape of the conductive lines and pads is applied to each of the aluminum layers in a silver layer having a thickness of 0.5 mil. The silver is applied as a conventional silver pigmented ink using a silk screen process with a 325 screen. After the silver is applied, unwanted aluminum is etched away using a conventional etching process to form the conductive lines and pads having a layer of aluminum covered with a layer of silver.

It has been observed that an unexpected reduction in resistance is found when the thin layer of aluminum is combined with the layer of silver. In a specific instance, measurements were taken of certain conductive lines.

Referring now to FIG. 4, an experimental flexible cover sheet was made up wherein conductive lines 201, 202 and 203 are made up in plain silver having a thickness of 0.5 mil having a configuration and identical to the aluminum and silver combination mentioned above, that is, the aluminum having a thickness of 0.0025 mil and the silver having a thickness 0.5 mil. The resistance of each conductive line from one end to the other end was measured. It was observed that conductive line 201 had a resistance of 24 ohms when the material was pure silver and a resistance of 17 ohms for the aluminum-silver combination. Conductive line 202 had a resistance of 26 ohms when all pure silver and 18 ohms with the aluminum-silver combination. Conductive line 203 had a resistance of 27 ohms when the line was pure silver and the aluminum-silver combination had a resistance of 19 ohms. The percentage reduction in resistance was approximately 40% reduction which was totally unanticipated by the further addition of a layer of aluminum which increased the thickness by less than 1%.

Although the present membrane switch has been described as part of a chessboard and specific constructions have been shown and described, it is to be expressly understood that the instant invention is limited only by the appended claims.

What is claimed is:

1. A membrane switch comprising; a base sheet having a plurality of conductive lines on one surface of the sheet, each of said conductive lines including a layer of aluminum along the entire length of each of the conductive lines and a layer of silver contacting the layer of aluminum along the entire length of each of the conductive lines, a spacer sheet having one side adjacent to the side of the base sheet having the conductive lines, said spacer sheet having a plurality of apertures, each of said apertures being aligned with a selected portion of a selected conductive line, a flexible cover sheet positioned adjacent to the other side of the spacer sheet, a second plurality of flexible second conductive lines on the side of the flexible cover sheet adjacent to said base sheet having selected portions of the second conductive lines positioned in alignment with selected apertures, each of said second conductive lines having a second layer of aluminum along the entire length of each of the conductive lines and a second layer of silver along the entire length of each of the conductive lines contacting said second layer of aluminum, whereby flexing of a selected portion of the cover sheet toward a selected aperture moves that selected portion of the flexible second conductive line on that selected portion of the flexible cover sheet through the selected apertures into electrical contact with a selected portion of a selected conductive line on the base sheet aligned with the selected aperture.

2. A membrane switch as defined in claim 1, wherein the base sheet and the cover sheet each includes a film of polyethylene glycol terephthalate.

3. A membrane switch as defined in claim 1 including; a transparent polycarbonate flexible indicator sheet positioned adjacent to the flexible cover sheet, and indicia on the side of the indicator sheet adjacent to the flexible cover sheet.

4. A membrane switch as defined in claim 1, wherein each of the first mentioned and the second layers of aluminum has a thickness substantially less than the thickness of the respective layer of silver contacting the layer of aluminum.

5. A membrane switch as defined in claim 1, wherein the base sheet is adhesively secured to the adjacent surface of the spacer sheet, and the flexible cover sheet is adhesively secured to the other side of the spacer sheet.

6. A membrane switch as defined in claim 1 including; a flexible indicator sheet adhesively secured to the flexible cover sheet, said indicator sheet being transparent, and indicia on the indicator sheet on the side adjacent to the flexible cover sheet, said indicia being aligned with respective apertures in the spacer sheet.

7. A membrane switch as defined in claim 1 including; a pad formed integral with each portion of each of the first mentioned conductive lines aligned with a given aperture, each of said pads including a pad layer of aluminum and a pad layer of silver contacting the pad layer of aluminum, and a second plurality of pads, each of said second plurality of pads formed integral with a selected portion of each of the second conductive lines and being aligned with a respective aperture, each of said pads of said second plurality of pads having a second pad layer of aluminum and a second pad layer of silver contacting the second pad layer of aluminum.

8. A membrane switch as defined in claim 1 including; a transparent polycarbonate flexible indicator sheet positioned adjacent to the flexible cover sheet, and indicia on the side of the indicator sheet adjacent to the flexible cover sheet, said base sheet and said cover sheet each being a film of polyethylene glycol terephthalate.

9. A membrane switch as defined in claim 1 including; a transparent polycarbonate flexible indicator sheet positioned adjacent to the flexible cover sheet, indicia on the side of the indicator sheet adjacent to the flexible cover sheet, said base sheet and said cover sheet each being a film of polyethylene glycol terephthalate, the first mentioned and second layers of aluminum in each of said conductive lines having a thickness substantially less than the thickness of the respective layer of silver.

10. A membrane switch as defined in claim 1 including; a pad formed integral with each portion of each of the first mentioned and second conductive lines, each pad aligned with a given aperture with pads on the first mentioned and second conductive lines being on opposite side of the same aperture, each of said pads including a pad layer of aluminum and a pad layer of silver contacting the pad layer of aluminum, said base sheet being adhesively secured to the adjacent surface of the spacer sheet, the flexible cover sheet being adhesively secured to the other side of the spacer sheet, and each layer of aluminum in the conductive lines and the pads has a thickness substantially less than the thickness of the respective layer of silver.

11. A membrane switch as defined in claim 1 including; a pad formed integral with each portion of each of the first mentioned conductive lines aligned with a given aperture, each of said pads including a pad layer of aluminum and a pad layer of silver contacting the pad layer of aluminum, and a second plurality of pads, each of said second plurality of pads formed integral with a given portion of each of the second conductive lines and being aligned with a respective aperture to be opposed to a respective pad on the first mentioned conductor line through the respective aperture, each of said pads of the second plurality of pads having a second pad layer of aluminum and a second pad layer of silver contacting the second pad layer of aluminum, each of the layers of aluminum of the conductive lines and pads being vacuum vapor deposited on its respective sheet, each of the layers of silver being silk screened on its respective layer of aluminum, the base sheet being adhesively secured to the adjacent surface of the spacer sheet, and the flexible cover sheet being adhesively secured to the other side of the spacer sheet, whereby flexing of the cover sheet through a selected aperture places a portion of the silver layer on the cover sheet in electrical contact with a portion of the silver layer on the base sheet.

12. A membrane switch comprising; a base sheet including a polyethylene glycol terephthalate film having conductive lines on one side of the film, a spacer sheet having one side adhesively secured to the side of the base sheet having the conductive lines, said spacer sheet having a plurality of apertures, each of said apertures being aligned with a selected portion of a selected conductive line, said spacer sheet being a sheet of polyethylene glycol terephthalate film having a thickness of 10 mils, a flexible cover sheet including a polyethylene glycol terephthalate film having a thickness of 2 mils adhesively secured to the other side of the spacer sheet, a second plurality of flexible conductive lines on the side of the flexible cover sheet adjacent to the base sheet, each of said flexible conductive lines having a portion positioned in alignment with a selected aperture, each of the first mentioned conductive lines and the flexible second conductive lines having a pad aligned with each aperture to provide opposing facing pads at each aperture, each of said first mentioned conductive lines and said flexible conductive lines and the respective pads being a layer of vacuum vapor deposited aluminum having a thickness of 0.0025 mil, and an indicator sheet being a polycarbonate film having a thickness of 10 mils and being transparent adhesively secured to the flexible cover sheet, said indicator sheet having indicia on the side of the polycarbonate film adjacent to the flexible cover sheet, said indicia being aligned with respective apertures to indicate appropriate positions for applying a flexing force to the flexible cover sheet, whereby flexing of a selected portion of the cover sheet at a selected aperture toward the base sheet moves that selected portion of the cover sheet and the portion of the flexible conductive line and pad on the selected portion of the flexible cover sheet through the selected aperture into electrical contact with a selected portion of a selected conductive line and respective pad on the base sheet aligned with the selected aperture.

13. A membrane switch comprising; a base sheet including a polyethylene glycol terephthalate film having a plurality of conductive lines on one surface of the film, a spacer sheet having one side adhesively secured to the one surface of the base sheet having the plurality of conductive lines, said spacer sheet having a plurality of apertures, each of said apertures being aligned with a selected portion of a selected conductive line, a flexible cover sheet including a second polyethylene glycol terephthalate film adhesively secured to the other side of the spacer sheet, a second plurality of second conductive lines on the side of the cover sheet adjacent to the base sheet and having selected portions positioned in alignment with selected apertures in the spacer sheet, a pad formed integral with each portion of each of the first mentioned and second conductive lines aligned with a given aperture, forming pads on opposite sides of each aperture, each of the conductive lines and integral pads including a layer of vacuum deposited aluminum on the respective film having a thickness of 0.0025 mil extending over the entire length of each of the conductive lines and each of the pads, a layer of silver having a thickness of one-half mil overlaying and contacting the entire surface of the layer of aluminum, a transparent flexible polycarbonate indicator sheet adhesively secured flexible polycarbonate indicator sheet adhesively secured to the cover sheet on the side opposite the side having the second conductive lines, and indicia on the side of indicator sheet adjacent to the cover sheet, said indicia being aligned with respective apertures in the spacer sheet, whereby application of an appropriate force to a selected indicia on the indicator sheet flexes the indicator sheet and the cover sheet to move the respective pad on the cover sheet through its respective aperture to contact the respective pad on the base sheet on the other side of the aperture to establish silver layer to silver layer electrical contact between said pads.

* * * * *

UNITED STATES PATENT OFFICE

CERTIFICATE OF CORRECTION

PATENT NO. : 4,317,011

DATED : February 23, 1982

INVENTOR(S) : Louis R. Mazurk

It is certified that error appears in the above-identified patent and that said Letters Patent are hereby corrected as shown below:

Col. 2, line 55, cancel "titled" and substitute -- tilted --.

Col. 2, line 57, cancel "titled" and substitute -- tilted --.

Col. 8, Claim 13, lines 51 and 52, cancel "flexible polycarbonate indicator sheet adhesively secured".

Signed and Sealed this

*Twenty-fifth* Day of *May 1982*

[SEAL]

*Attest:*

GERALD J. MOSSINGHOFF

*Attesting Officer*

*Commissioner of Patents and Trademarks*